US006060978A

United States Patent [19]

Marquardt

[11] Patent Number: 6,060,978

[45] Date of Patent: May 9, 2000

[54] MAGNETIC ASSEMBLY FOR A TRANSFORMER OR THE LIKE

[75] Inventor: Terry Lynn Marquardt, St. Charles, Ill.

[73] Assignee: Siemens Energy & Automation, Inc., Alpharetta, Ga.

[21] Appl. No.: 09/217,551

[22] Filed: Dec. 21, 1998

Related U.S. Application Data

[63] Continuation of application No. 08/838,905, Apr. 11, 1997, abandoned.

[51] Int. Cl.[7] ..... H01F 27/24

[52] U.S. Cl. ..... 336/234; 336/212; 336/216

[58] Field of Search ..... 336/234, 212, 336/216, 217

[56] References Cited

U.S. PATENT DOCUMENTS

| | | | |
|---|---|---|---|
| 4,827,237 | 5/1989 | Blackburn | 336/212 |
| 4,897,916 | 2/1990 | Blackburn | 336/217 |

FOREIGN PATENT DOCUMENTS

| | | | |
|---|---|---|---|
| 0353029 | 1/1990 | European Pat. Off. . | |
| 514079 | 2/1921 | France . | |
| 219466 | 3/1910 | Germany . | |
| 1638943 | 4/1970 | Germany . | |
| 1638944 | 4/1970 | Germany . | |
| 63-76407 | 4/1988 | Japan | 336/212 |

OTHER PUBLICATIONS

Patent Abstract of Japan, vol. 007, No. 272 (E–214), Dec. 3, 1983, Publn. No. JP 58153314 (Toyo Denso KK), Sep. 12, 1983.

*Primary Examiner*—Michael L. Gellner
*Assistant Examiner*—Anh Mai

[57] ABSTRACT

Size constraints imposed by riveting of the laminations of a sensing core transformer that cost constraint imposed through the use of adhesive in assembling laminations together in a sensing core along with the use of additional fasteners are eliminated through the use of two lamination assemblies, that are interference fitted at complementary surfaces to form a series of lamination assemblies to which a coil assembly may be applied. Individual laminations may be held together by stake holding structure.

12 Claims, 2 Drawing Sheets

MAGNETIC ASSEMBLY FOR A TRANSFORMER OR THE LIKE

This is a continuation of application Ser. No. 08/838,905 filed Apr. 11, 1997 now abandoned.

FIELD OF THE INVENTION

This invention relates to laminated magnetic assemblies such as may be employed in transformers or other electrical apparatus.

BACKGROUND OF THE INVENTION

As is well known, laminations made of sheets of ferrous material are employed in various electrical apparatus and provide a magnetic path. In transformers, the laminations provide a magnetic path around an electric current developed in a winding or other electrical conductor.

In some uses, as when the laminated assembly is employed as an electric sensor core in an overload relay and is required to respond linearly at low currents and continue a linear output throughout the desired current range while having an adequate high saturation level, the laminated assembly requires a large cross sectional area with minimal air gaps. Conventionally, this has been achieved through the use of laminations of relatively thin, sheets of ferrous material configured generally in the form of a "U" or a "D". The laminations are achieved by "U-U" or "D-U" laminations stacked in a sequence. This type of construction tends to require extra width on the ends of the laminations to compensate for the air gaps left between groups of laminations. Also typically, the laminations are riveted together or adhesively assembled using varnish or epoxy resin, or even held together with spring clips. If the extra width is not permitted because of spacial requirements of a given use, then two laminations are used per layer so as to minimize the air gap. However, as the extra width is eliminated and the assembly becomes narrower, it becomes increasingly difficult to utilize rivets to secure the laminations together. Moreover, as the assembly becomes thicker, spring clips lose their effectiveness and the use of varnish and/or epoxy as an adhesive tends to be messy and time consuming.

As a consequence, magnetic assemblies made up of laminations for use in transformers and the like have either been bulky, i.e. undesirably large, with a consequence that the volume of the equipment in which they are employed is increased or, if of an appropriate size matched to the requisite magnetic efficiency for the particular use, undesirably expensive to fabricate.

The present invention is directed to providing a compact magnetic assembly of the type that may be used in a transformer and which is economical to manufacture.

SUMMARY OF THE INVENTION

It is the an object of the invention to provide a new and improved magnetic assembly for use in a transformer or the like. More specifically, it is an object of the invention to provide such an assembly that is economically manufactured and yet may be of small volume so as to reduce the space occupied by the same in a given particular piece of electrical equipment.

An exemplary embodiment of the invention achieves the foregoing object in a magnetic assembly for a transformer of the like that includes a first series of substantially identical laminations, each made up of a thin sheet of ferrous material, and abutted against one another in aligned relation. The laminations of the first series include a first open area flanked by spaced, opposed first surfaces. First holding means hold the first series in assembled relation. A second series of substantially identical laminations are provided and each is made up of a thin sheet of ferrous material and they are abutted against one another in aligned relation. A second holding means hold the second series in assembled relation. The laminations of the second series are configured to be assembled to the laminations of the first series and define therewith a closed loop of the ferrous material. The laminations of the second series have spaced, opposed second surfaces configured to be complementary to a corresponding one of the first surfaces and abutting the same. The distance between the first surfaces, before assembly of the first series to the second series, is slightly more or slightly less than the distance between the second surfaces so that upon assembly of the first series and the second series to one another, an interference fit exists between the first and second series at the first and second surfaces to hold the first and second series in assembled relation. An electrical winding is disposed about at least one of the first and second series and at least partially occupies the open area.

In a preferred embodiment, the first surfaces face one another while the second surfaces face oppositely of one another.

In a preferred embodiment, one of the first and second surfaces is concave and the other of the first and second surfaces is convex.

In another preferred embodiment, the first and second surfaces are generally parallel to one another.

A highly preferred embodiment includes a third series of substantially identical laminations, each made up of a thin sheet of ferrous material and abutted against one another in aligned relation. The laminations of the third series include a second open area flanked by spaced, opposed third surfaces. A fourth series of substantially identical laminations is included and each is made up of a thin sheet of ferrous material and abutted against one another in aligned relation. The laminations of the fourth series are configured to be assembled to the laminations of the third series and define therewith a closed loop of the ferrous material. The laminations of the fourth series have spaced, opposed surfaces configured to be complimentary to a corresponding one of the third surfaces and abutting the same. The distance between the third surfaces, before assembly of the third series and the fourth series is slightly greater or slightly less than the distance between the fourth surfaces so that upon assembly of the third series and the fourth series to one another, an interference fit exists between the third and fourth series at the third and fourth surfaces to hold the third and fourth series in assembled relation. Means hold the laminations of the third series in abutting relation and means are provided to hold the laminations of the fourth series in abutting relation. The laminations of the third series have a different configuration than the laminations of the first series while the laminations of the second series have a different configuration than the laminations of the fourth series. Means assemble the first and second series to the assembled third and fourth series with the first and second open areas aligned. The electrical winding at least partially occupies both the open areas so that the magnetic assembly comprises two closed loops of ferrous material, each of two series of laminations, with the laminations of one loop overlapping the laminations of the other loop to achieve a desired magnetic efficiency.

In one embodiment, the first and fourth series of laminations have the same configuration and the second and third series of laminations have the same configuration. In this embodiment of the invention, the first and third series are assembled in abutting relation and the second and fourth series are in abutting relation to minimize the existence of significant air gaps.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DESCRIPTION OF THE PREFERRED EMBODIMENTS

Figure 1:
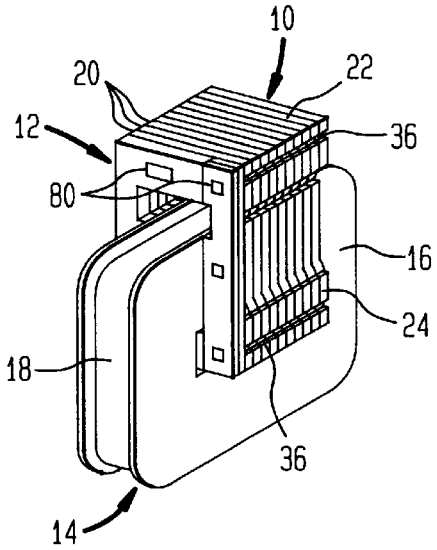
FIG. 1 is a perspective view of a sensing transformer embodying the invention.

An exemplary embodiment of a magnetic assembly for use in, for example, a sensing core transformer as employed in an overload relay, is illustrated in FIGS. 1, 2, 4 and 5. The same is seen to include a first lamination assembly, generally designated 10, a second lamination assembly, generally designated 12 and abutted to one side of the lamination assembly 10, and an electrical coil assembly, generally designated 14 mounted thereto. As is well known, in a sensing core transformer, another conductor will typically be employed as, for example, a conventional bus bar (not shown) disposed to extend through the lamination assemblies 10 and 12 in a conventional fashion.

The coil assembly 14 is conventional and includes a bobbin 16 made of a conventional insulating material as, for example, a plastic. An electrical conductor 18 is wound about the bobbin 16 to form an electrical coil.

Figure 4:
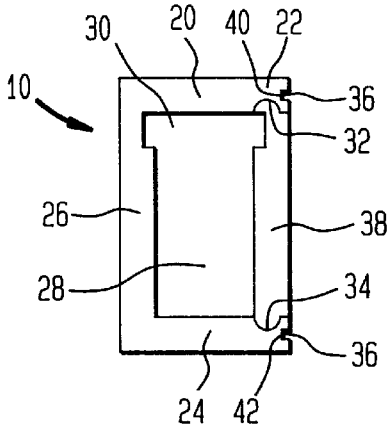
FIG. 4 is a side elevation of a first and second series of laminations employed in the embodiment of FIG. 1.

As seen in FIG. 4, the lamination assembly 10 is made up of a series of U-shaped laminations 20 having opposed, generally parallel legs 22 and 24 connected by a bight 26. As a result, a central open area 28 is defined. As illustrated, the open area 28 has a somewhat enlarged upper end 30. As can be seen in FIG. 1, the bobbin 16 is impaled on the leg 24 and is such is to substantially fill the central area 28 except for the enlarged area 30. The latter is reserved for the bus bar (not shown) mentioned earlier.

The legs 22 terminate in facing concave surfaces 32 and 34 respectively. The ends of the legs 22 and 24 are also provided with notches 36 for purposes to be disclosed.

Extending between the concave surfaces 32 and 34 is a second series of laminations 38 which, with the first series 20, defines a closed loop of the ferrous material. The laminations 38 terminate in oppositely directed convex surfaces 40 and 42 which are complimentary with and engage the surfaces 32 and 34 as best seen in FIG. 4.

Figure 5:
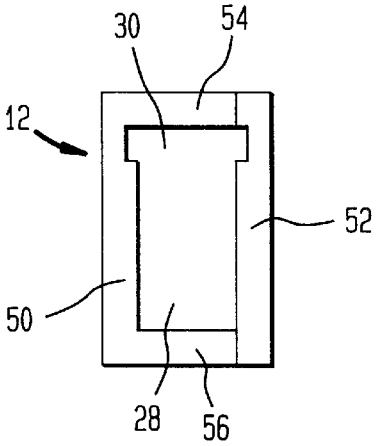
FIG. 5 is a side elevation of third and fourth series of laminations employed in the embodiment of FIG. 1.
Figure 6:
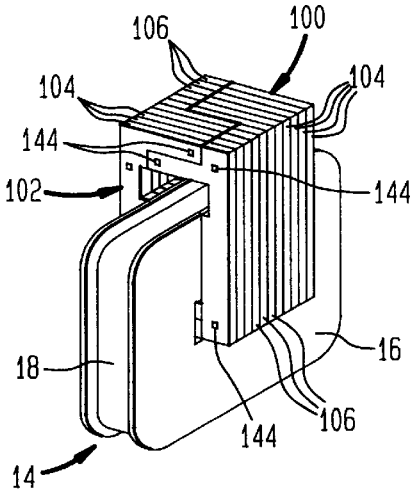
FIG. 6 is a perspective view of another embodiment of the invention.
Figure 7:
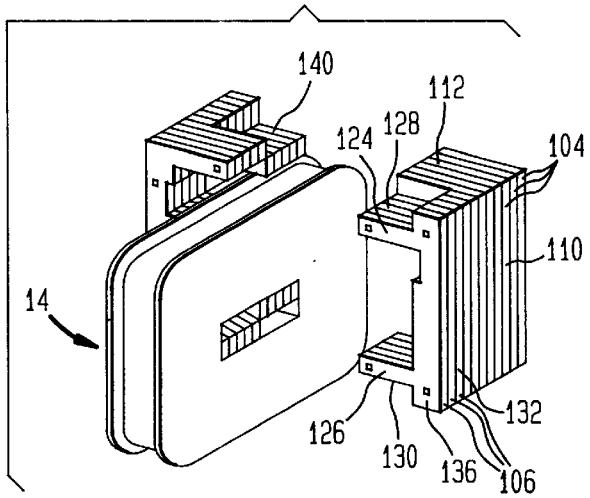
FIG. 7 is an exploded view of the embodiment shown in FIG. 6.
Figure 8:
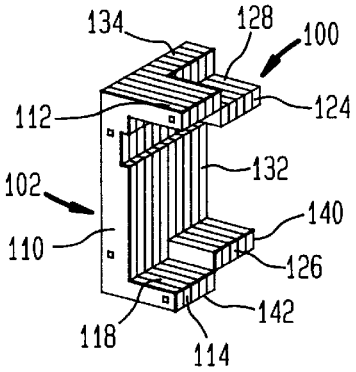
FIG. 8 is a view of two lamination assemblies utilized in the embodiment shown in FIG. 6 and 7.

The second lamination assembly 12, as best seen in FIG. 5, also includes a series of generally U-shaped laminations 50 having an open central area 28 with an enlarged open end 30 as before. The open area 28 may be closed by a fourth series of laminations 52 which bridges the legs 54, 56 of the laminations 50 again to form a closed loop of the ferrous material.

It is important to note that the distance between the facing surfaces 32 and 34 of the lamination assembly 10 is slightly less than the distance between the opposed, oppositely directed surfaces 40, 42 of the laminations 38. Typically, the difference in distance will be on the order of 0.020 inches. This provides a means whereby when the surface 32 is abutted to the surface 40 and the surface 34 is abutted to the surface 42, an interference fit will result to hold the laminations 38 assembled to the laminations 20.

Figure 3:
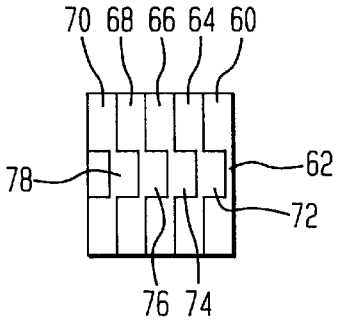
FIG. 3 is an enlarged, fragmentary, sectional view of a so called "partial perfing" or stake locking construction utilized to hold laminations together.

To hold individual laminations 20 in assembled and aligned relation, they are typically held by a construction known as partial perfing or stake locking. An example of stake locking is illustrated in FIG. 3 and the endmost lamination 60 in a stack includes an opening 62. The adjacent laminations 64, 66, 68 and 70 all have respective perforations displaced into the adjacent lamination. Thus, the lamination 64 has a perforation 72 displaced into the opening 62 while the lamination 66 includes a perforation 74 displaced into the perforation 72. The lamination 68 includes a perforation 76 displaced into perforation 74 while the lamination 70 includes a perforation 78 displaced into the perforation 76. This type of construction is known in the art and will not be described further herein. Equipment for forming the partial perforations or stake holding structure may be obtained, for example, from Swanbro Corporation of Elk Grove Village, Ill. or L. H. Carbide of Fort Wayne, Ind.

Figure 2:
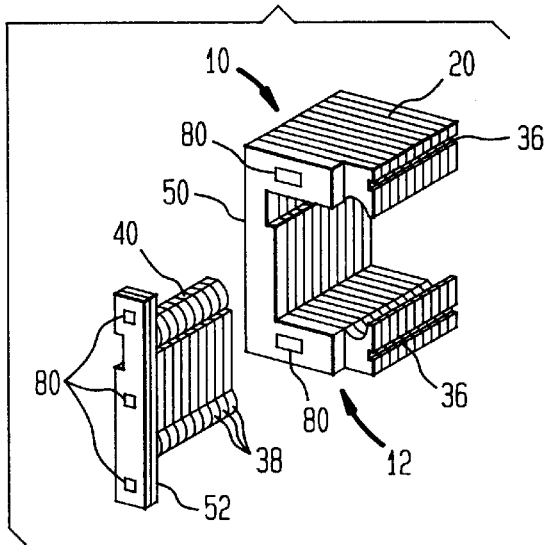
FIG. 2 is an exploded view of the sensing core with its coil removed.

As can be seen in FIG. 2, the laminations 50 making up the part of the second lamination assembly 12 are assembled together, and to the laminations 20 making up part of the first lamination assembly 10 and are all held in place by locking means of the sort just described at locations such as illustrated at 80. Similar structure, also shown at 80, may be used to fasten the laminations 52 to one another and to the laminations 38.

In the embodiment illustrated in FIGS. 1–5, inclusive, the legs 22 and 24 of the first lamination assembly 10 may be spread slightly by placing a tool in the notches 36 and applying an expanding force thereto. This allows that part of the lamination assembly 10 made up of the laminations 38 and that part of the lamination assembly 12 made up of the laminations 52 to be inserted laterally in place after, of course, the winding assembly 14 has been impaled on the lamination assemblies. When the expanding force applied to the notches 36 is released, an interference fit results.

It is to be particularly observed that in this embodiment of the invention, the configuration of the laminations 20 is different from that of laminations 50, which in turn is different from that of the laminations 38, which in turn is different from that of laminations 52. When assembled, the laminations 38 will be generally aligned with the laminations 52 while the laminations 20 will be aligned with the laminations 50. However, because of their difference in configuration, there will be considerable overlap to prevent any single continuous air gap which could interfere with the magnetic efficiency of the assembly. By appropriately selecting the number of laminations in each of the assemblies 10 and 12, the air gaps that are present can be adjusted to set the system for a range of amperage that is desired for the particular piece of equipment with which the cores are to be used.

A further, and highly preferred embodiment is illustrated in FIGS. 6–12, inclusive. In this embodiment, the coil assembly 14 is again employed and includes the bobbin 16 along with an electrical winding 18 thereon. Two lamination assemblies, generally designated 100 and 102, are employed in this embodiment of the invention. Each is made up of a plurality of laminations 104 that are interferenced fitted in assembled relation with a plurality of laminations 106. As illustrated, the number of laminations employed in each of the assemblies 100 and 102 is the same and as with all the laminations, each is made up of a thin sheet of ferrous material, usually steel. However, on some instances, a different number of lamination, and/or differing thickness of the assemblies 100 and 102 may be used to develop particular magnetic characteristics.

Figure 9:
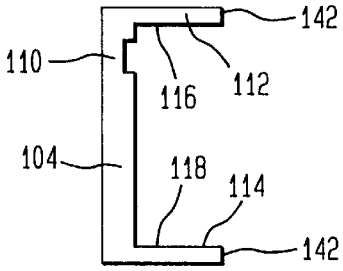
FIG. 9 is a side elevation of one lamination configuration used in the embodiment of FIG. 6.
Figure 10:
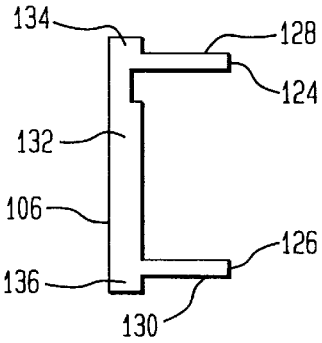
FIG. 10 is a side elevation of another lamination configuration used in the embodiment of FIG. 6.

Each of the assemblies 100 and 102 in turn is made up of a series of the laminations 104 together with a series of the laminations 106. The configuration of the laminations 104 is shown in FIG. 9 and is basically that of a shallow U-shape having a central bight 110 flanked by legs 112 and 114. The legs 112 and 114 have facing, generally parallel surfaces 116 and 118 respectively.

Figure 11:
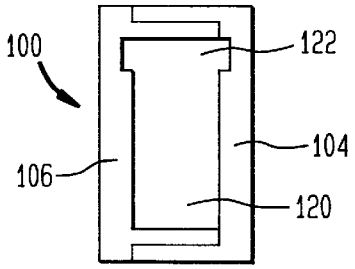
FIG. 11 is a side elevation of one assembly configuration of the laminations of FIGS. 9 and 10.

The space between the legs 112 and 114 defines a central open area 120 as seen in FIG. 11 and which may be closed off by assembly of the laminations 106 to the laminations 104 as illustrated in FIG. 11 to form a closed loop of magnetic material. Again, the open area of 120 has an enlarged upper end 122 for receipt of a bus bar or the like while the remainder of the open area 112 receives one part of the bobbin 16.

Each lamination 106 is also somewhat U-shaped but in this case, the two legs 124 are located somewhat closer to one another than the legs 112 and dimensioned so that they nest within the legs 112 and 114. In this regard, the legs 124 and 126 have oppositely facing, generally parallel surfaces 128 and 130 that are adapted to interference fit with the surfaces 116 and 118 on the legs 112 and 114 of the laminations 104. Preferably, the surfaces 128 and 130 are approximately 0.020 inches further apart than the surfaces 116 and 118 to achieve the desired interference fit.

Figure 12:
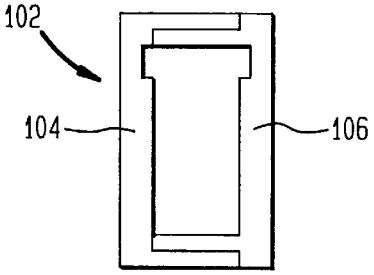
FIG. 12 is a side elevation of another assembly configuration of the laminations of FIGS. 9 and 10.

The bight 132 of each of the laminations 106 is extended somewhat past the legs 124 and 126 to provide extensions 134 and 136 which, together with the outer surfaces of the legs 112 and 114, form a rectangular peripheral shape as seen in FIGS. 11 and 12.

FIG. 11 illustrates how the laminations 104 and 106 are arranged to provide the first lamination assembly 100 while FIG. 12 illustrates the arrangement of the laminations 104 and 106 to form the second lamination assembly 102.

Preferably, the outer most corners of the legs 124 and 126 may be slightly chamfered as at 140. A similar chamfer 142, may be located on the inner corners of the legs 112 and 114 to aid in assembly so that the legs 112, 114 may be cammed somewhat apart by the legs 124 and 126 to achieve the desired interference fit between the surfaces 116 and 128 and the surfaces 118 and 130.

Typically, stake holding formations as shown at 144 and are generally as described in connection with the first embodiment are used as a holding means. They are not only used to hold the laminations 104 and the laminations 106 in abutting relation to each other, but also may be used at the interface of the assemblies 100 and 102 to hold them in assembled relation as well.

The embodiment shown in FIGS. 6–12 is a preferred embodiment in the sense that only two different lamination configurations are required, that is, only the lamination shapes of the laminations 104 and 106 are needed. In contrast, four different lamination shapes are required for the embodiment of FIGS. 1–5, which in turn means it is more expensive to tool.

In the embodiment shown in FIGS. 6–12, overlaps to control air gap losses are achieved simply by making the laminations 104 and 106 of a different configuration but then reversing their side to side arrangement as they are stacked by abutting the assembly 100 to the assembly 102 as illustrated in the drawings.

From the foregoing, it will be appreciated that a core for a transformer or the like made according to the invention can be made of relatively small size. Wide parts of the laminations heretofore required so as to allow the laminations to be assembled by rivets are avoided. The use of the stake holding means to assemble the individual laminations in a given series to one another also provides a means of eliminating other securing methods such as spring clips or adhesives heretofore employed. At the same time, the use of an interference fit to secure lamination parts to one another to define a closed loop of ferrous material which is at least partially occupied by the coil provides a further means whereby conventional fastening methods may be avoided. Ultimately, the unique structures and methods employed result in a sensing coil of economical construction and yet of relatively small bulk so that it may be readily and advantageously incorporated in electrical apparatus requiring small size.

Furthermore, the unique arrangement of laminations of differing configurations allows one to control air gaps within the overall assembly to achieve a desired magnetic effectiveness, dependent upon the ultimate use to which the sensing cores are to be put.

Additional advantages and modifications will readily occur to those skilled in the art. Therefore, the invention in the broader aspects is not limited to the specific details, and representative devices, shown and described herein. Accordingly, various modifications may be made without departing from the spirit or scope of the general inventive concept as defined by the appended claims and their equivalents.

I claim:

1. A magnetic assembly, comprising:

a first series of substantially identical laminations, each made up of a thin sheet of ferrous material, and abutted against one another in aligned relation;

the laminations of said first series including a first open area flanked by spaced, opposed, first surfaces;

first stake locks holding said first series in assembled relation;

a second series of substantially identical laminations, each made up of a thin sheet of ferrous material and abutted against one another in aligned relation;

second stake locks holding said second series in assembled relation;

the laminations of said second series being configured to be assembled to the laminations of said first series and defined therewith a closed loop of said ferrous material;

the laminations of said second series having spaced, oppositely directed second surfaces configured to be complementary to a corresponding one of said first surfaces and abutting the same;

the distance between one of said first and second surfaces, before assembly of said first series and said second series, being slightly less than the distance between the other of said first and second surfaces so that, upon assembly of said first series to one another and said second series, an interference fit exists between said first and second series at said first and second surfaces to hold said first and second series in assembled relation;

a third series of substantially identical laminations, each made up of a thin sheet of ferrous material, and abutted against one another in aligned relation;

the laminations of said third series including a second open area flanked by spaced, opposed, third surfaces;

a fourth series of substantially identical laminations, each made up of a thin sheet of ferrous material and abutted against one another in aligned relation;

the laminations of said fourth series being configured to be assembled to the laminations of said third series and define therewith a closed loop of said ferrous material;

the laminations of said fourth series having spaced oppositely directed fourth surfaces configured to be complementary to a corresponding one of said third surfaces and abutting the same;

a distance between one of said third and fourth surfaces, before assembly of said third series and said fourth series, being slightly less than a distance between the other of said third and fourth surfaces so that, upon assembly of said third series and said fourth series to one another, an interference fit exists between said third and fourth series at said third and fourth surfaces to hold said third and fourth series in assembled relation;

means holding the laminations of said third series in abutting relation;

means holding the laminations of said fourth series in abutting relation;

the laminations of said third series having a different configuration than the laminations of said first series;

the laminations of said second series having a different configuration than the laminations of said fourth series; and means assembling the assembled first and second series to the assembled third and fourth series with said first and second open areas aligned;

said electrical winding at least partially occupying both said open areas;

whereby said magnetic assembly comprises two closed loops off errous material, each of two series of laminations, with the laminations of one loop overlapping the laminations of the other loop to achieve a desired magnetic efficiency.

2. The magnetic assembly of claim 1 wherein said first and fourth series of laminations have the same configuration and said second and third series of laminations have the same configuration, and wherein said assembling means assemble said first and third series in abutting relation and assemble said second and fourth series in abutting relation.

3. A magnetic assembly comprising:

a first series of substantially identical laminations, each made up of a thin sheet of ferrous material, and abutted against one another in aligned relation;

the laminations of said first series including a first open area flanked by spaced, opposed, facing first surfaces;

first means holding said first series in assembled relation;

a second series of substantially identical laminations, each made up of a thin sheet of ferrous material and abutted against one another in aligned relation;

second means holding said second series in assembled relation, the laminations of said second series being configured to be assembled to the laminations of said first series and define therewith a closed loop of said ferrous material;

the laminations of said second series having spaced, oppositely directed second surfaces configured to be complementary to a corresponding one of said first surfaces and abutting the same;

a distance between one of said first and second surfaces, before assembly of said first series and said second series, being slightly less than distance between the other of said first and second surfaces so that, upon assembly of said first series and said second series to one another, an interference fit exists between said first and second series at said first and second surfaces to hold said first and second series in assembled relation;

a third series of substantially identical laminations, each made up of a thin sheet of ferrous material, and abutted against one another in aligned relation;

the laminations of said third series including a second open area flanked by spaced, opposed, facing third surfaces;

a fourth series of substantially identical laminations, each made up of a thin sheet of ferrous material and abutted against one another in aligned relation;

the laminations of said fourth series being configured to be assembled to the laminations of said third series and define therewith a closed loop of said ferrous material;

the laminations of said fourth series having spaced oppositely directed fourth surfaces configured to be complementary to a corresponding one of said third surfaces and abutting the same;

a distance between one of said third and fourth surfaces, before assembly of said third series and said fourth series, being slightly less than a distance between the other of said third and fourth surfaces so that, upon assembly of said third series and said fourth series to one another, an interference fit exists between said third and fourth series at said third and fourth surfaces to hold said third and fourth series in assembled relation;

means holding the laminations of said third series in abutting relation;

means holding the laminates of said fourth series in abutting relation;

the laminations of said third series having a different configuration than the laminations of said first series;

the laminations of said second series having a different configuration than the laminations of said fourth series; and means assembling the assembled first and second series to the assembled third and fourth series with said first and second open areas aligned;

an electrical winding disposed about at least one of said first and second series and at least partially occupying said open area;

whereby said magnetic assembly comprises two closed loops of ferrous material, each of two series of laminations, with the laminations of one loop overlapping the laminations of the other loop to achieve a desired magnetic efficiency.

4. The magnetic assembly of claim 3, wherein complementary ones of said surfaces are concave and convex.

5. The magnetic assembly of claim 3, wherein complementary ones of said surfaces are parallel.

6. A magnetic assembly comprising:

a first series of substantially identical laminations, each made up of a thin sheet of ferrous material, and abutted against one another in aligned relation;

the laminations of said first series including a first open area flanked by spaced, opposed, facing first surfaces;

first means holding said first series in assembled relation;

a second series of substantially identical laminations, each made up of a thin sheet of ferrous material and abutted against one another in aligned relation;

second means holding said second series in assembled relation;

the laminations of said second series being configured to be assembled to the laminations of said first series and define therewith a closed loop of said ferrous material;

the laminations of said second series having spaced, oppositely directed second surfaces configured to be complementary to a corresponding one of said first surfaces and abutting the same;

a distance between one of said first and second surfaces, before assembly of said first series and said second series, being slightly less than a distance between the other of said first and second surfaces so that, upon assembly of said first series and said second series to one another, an interference fit exists between said first and second series at said first and second surfaces to hold said first and second series in assembled relation;

a third series of substantially identical laminations, each made up of a thin sheet of ferrous material, and abutted against one another in aligned relation;

the laminations of said third series including a second open area flanked by spaced, opposed, facing third surfaces;

a fourth series of substantially identical laminations, each made up of a thin sheet of ferrous material and abutted against one another in aligned relation;

means holding the laminations of said fourth series in abutting relation;

the laminations of said third series having a different configuration than the laminations of said first series;

the laminations of said second series having a different configuration than the laminations of said fourth series; and means assembling the assembled first and second series to the assembled third and fourth series with said first and second open areas aligned; and an electrical winding disposed about at least one of said first and second series and at least partially occupying said open area;

whereby said magnetic assembly comprises two closed loops of ferrous material, each of two series of laminations, with the laminations of one loop overlapping the laminations of the other loop to achieve a desired magnetic efficiency.

7. The magnetic assembly of claim 6, wherein all of said series have different configurations.

8. A magnetic assembly comprising:

a first series of substantially identical laminations, each made up of a thin sheet of ferrous material, and abutted against one another in aligned relation;

the laminations of said first series including a first open area flanked by spaced, opposed, facing first surfaces;

first means holding said first series in assembled relation;

a second series of substantially identical laminations, each made up of a thin sheet of ferrous material and abutted against one another in aligned relation;

second means holding said second series in assembled relation, the laminations of said second series being configured to be assembled to the laminations of said first series and define therewith a closed loop of said ferrous material;

the laminations of said second series having spaced, oppositely directed second surfaces configured to be complementary to a corresponding one of said first surfaces and abutting the same;

the distance between one of said first and second surfaces, before assembly of said first series and said second series, being slightly less than the distance between the other of said first and second surfaces so that, upon assembly of said first series and said second series to one another, an interference fit exists between said first and second series at said first and second surfaces to hold said first and second series in assembled relation;

a third series of substantially identical laminations, each made up of a thin sheet of ferrous material, and abutted against one another in aligned relation;

the laminations of said third series including a second open area flanked by spaced, opposed, facing third surfaces;

a fourth series of substantially identical laminations, each made up of a thin sheet of ferrous material and abutted against one another in aligned relation;

the laminations of said fourth series being configured to be assembled to the laminations of said third series and define therewith a closed loop of said ferrous material;

the laminations of said fourth series having spaced oppositely directed fourth surfaces configured to be complementary to a corresponding one of said third surfaces and abutting the same;

the distance between one of said third and fourth surfaces, before assembly of said third series and said fourth series, being slightly less than the distance between the other of said third and fourth surfaces so that, upon assembly of said third series and said fourth series to one another, an interference fit exists between said third and fourth series at said third and fourth surfaces to hold said third and fourth series in assembled relation;

means holding the laminations of said third series in abutting relation;

means holding the laminates of said fourth series in abutting relation;

means assembling the assembled first and second series to the assembled third and fourth series with said first and second open areas aligned; and an electrical winding disposed about at least one of said first and second series and at least partially occupying said open area;

whereby said magnetic assembly comprises two closed loops of ferrous material, each of two series of laminations, with the laminations of one loop overlapping the laminations of the other loop to achieve a desired magnetic efficiency.

9. The magnetic assembly of claim 8 wherein the laminations of said third series have a different configuration than the laminations of said first series.

10. The magnetic assembly of claim 8 wherein the laminations of said second series have a different configuration than the laminations of said fourth series.

11. The magnetic assembly of claim 10 wherein the laminations of said third series have a different configuration than the laminations of said first series.

12. The magnetic assembly of claim 8 wherein the laminations of said third series are substantially identical to the laminations of said first series and the laminations of said second series are substantially identical to the laminations of said fourth series.

* * * * *